United States Patent [19]

Charney et al.

[11] 4,422,789

[45] Dec. 27, 1983

[54] FLUID APPLICATOR WITH FEEDER ROLLER

[76] Inventors: Joseph C. Charney, 7915 N. Fairfield Rd., Milwaukee, Wis. 53217; Phillip M. Goodman, 9018 N. 70 St., Milwaukee, Wis. 53223; Robert H. Morgan, 3745 S. 76th, Milwaukee, Wis. 53220

[21] Appl. No.: 344,545

[22] Filed: Feb. 1, 1982

Related U.S. Application Data

[63] Continuation of Ser. No. 193,001, Oct. 2, 1980, abandoned.

[51] Int. Cl.[3] ..... B43M 11/02

[52] U.S. Cl. ..... 401/218; 401/146; 401/149; 401/197

[58] Field of Search ..... 401/208, 197, 218, 146, 401/149, 150

[56] References Cited

U.S. PATENT DOCUMENTS

| | | | |
|---|---|---|---|
| 2,563,048 | 8/1951 | Liebelt et al. | 401/197 |
| 2,563,049 | 8/1951 | Liebelt et al. | 401/197 |
| 2,606,334 | 8/1952 | Vaden et al. | 401/197 |
| 2,610,582 | 9/1952 | Sprung | 401/218 X |
| 2,616,367 | 11/1952 | Sprung | 401/218 X |
| 3,030,652 | 4/1962 | Whitefield et al. | 401/218 |
| 3,135,005 | 6/1964 | Karkut | 401/218 X |
| 3,192,554 | 7/1965 | Karkut | 401/218 |
| 3,193,868 | 7/1965 | Cassidy | 401/218 X |
| 3,977,797 | 8/1976 | Paterson | 401/197 X |
| 4,217,062 | 8/1980 | Trp et al. | 401/197 X |

FOREIGN PATENT DOCUMENTS

| | | | |
|---|---|---|---|
| 903913 | 12/1953 | Fed. Rep. of Germany | 401/208 |
| 950444 | 10/1956 | Fed. Rep. of Germany | 401/208 |
| 1024856 | 2/1958 | Fed. Rep. of Germany | 401/197 |
| 589937 | 3/1959 | Italy | 401/197 |

*Primary Examiner*—Steven A. Bratlie

*Attorney, Agent, or Firm*—Shoemaker and Mattare, Ltd.

[57] ABSTRACT

A fluid applicator includes a fluid applicator roller engaged with a fluid dispersing roller. The fluid dispersing roller includes a pair of helical fluid dispersing troughs which receive fluid from a pump which is operated by a control located on a handle of the fluid applicator.

12 Claims, 3 Drawing Figures

10
98
100
AP
22
AF
24
96
94
90
106
102
26
28
12
92
80
84
86
82
16
18
36
42
52
20
C
72
54
56
40
48
46
70
32
50
14
58
30
60
66

160
26
162
124
164
150
110
118
122
126
120
114
140
144
116
112
136
138
134
148
146
130
132
202
174
170
210
244
212
232
230
200
192
190
214
24
216
194
98
100
176
180
182
22
3
3
102
86
OFF
ON
84
80
92
90
96

180
242
250
216
240
244
230
212
190
200
24
192
214
182
22

FLUID APPLICATOR WITH FEEDER ROLLER

This is a continuation of application Ser. No. 193,001, filed Oct. 2, 1980 now abandoned.

BACKGROUND OF THE INVENTION

The present invention relates in general to fluid applicators, and, more particularly, to roller-type paint applicators.

There are many situations wherein a fluid is to be applied to a surface. Chief among these situations is that of applying paint, shellac, stain, or the like to exterior or interior surfaces, or to textiles, or the like.

The above-mentioned painting procedures are often carried out using roller-type paint applicators.

A serious problem associated with such paint applicators is created by a necessity to stop the paint applying step to dip the roller into a paint container at various times during the process.

This problem of interrupted liquid application has engendered several inventive devices, such as those described in U.S. Pat. Nos. 2,419,338, 3,320,630, 3,620,633 and 4,140,410. These devices often do not apply the paint to the roller applicator evenly and thus create a potential for a blotchy application of paint.

SUMMARY OF THE INVENTION

The device embodying the teachings of the present invention can be used to evenly apply fluid, such as paint, or the like, to a surface without stopping to dip a roll into a container of that fluid.

The device includes a carriage on which a handle and a pair of contacting rollers are supported. A motor driven pump is associated with a source of fluid to be applied and is controlled by a switch on the handle.

One of the rollers is a paint applicator roller and one of the rollers is a paint source roller. The paint source roller has a pair of helical fluid troughs fluidly connected to dispersement holes to receive fluid from transfer passages connecting those holes to a fluid passage extending axially of the roller. Fluid from the source is pumped through a flexible hose to a fluid path through a support arm for the rollers to the axial passage in the source roller. The source roller is an idler-type roller in the preferred embodiment which is turned via frictional engagement with the paint applicator roller which rotates as that roller moves over a surface to which the fluid is being applied. The fluid flows through a porous cover mounted on the source roller to cover the dispersement holes, and is evenly applied to the applicator roller. The position of the rollers with respect to each other and with respect to the handle can be changed as suitable.

The applicator device of the present invention can be used to apply paint in regular painting procedures or in applying designs with paint to exterior surfaces, interior surfaces, ceilings or the like. This device can be used for applying stain and designs to textiles. The present applicator can be used with conventional paint rollers for the home market, or may be modified to be elongated to accommodate longer and wider rollers for the commercial market.

The device can be applied to paint edgers, or the like.

OBJECTS OF THE INVENTION

It is an object of the present invention to evenly apply fluid to a surface with a roller without requiring the dipping of that roller into a source of fluid.

It is another object of the present invention to evenly apply fluid to an applicator roller in a roller-type paint applicator device.

These together with other objects and advantages which will become subsequently apparent reside in the details of construction and operation as more fully hereinafter described and claimed, reference being had to the accompanying drawings forming part hereof, wherein like reference numerals refer to like parts throughout.

DETAILED DESCRIPTION OF THE INVENTION

Figure 1:
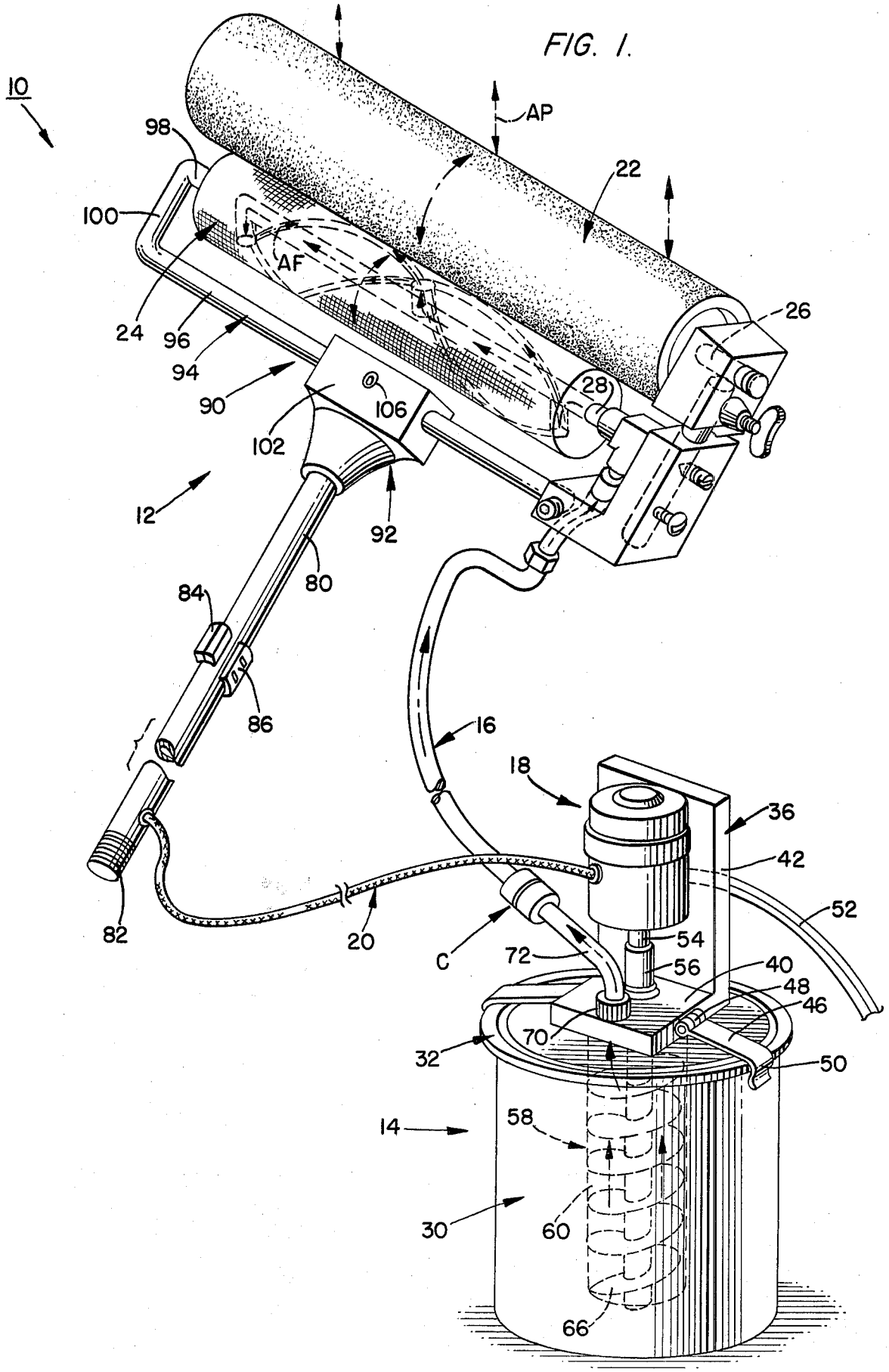
FIG. 1 is a perspective of a fluid applicator embodying the teachings of the present invention.

Shown in FIG. 1 is a fluid applicator device 10 embodying the teachings of the present invention. The device 10 includes a frame 12 coupled to a fluid source 14 by a flexible tube 16 and to an electric motor 18 by a cable 20. A pair of rollers 22 and 24 are mounted by shafts 26 and 28, respectively, on the frame to be rotatable about the longitudinal axes thereof. The roller 22 is a fluid applicator roller and is pressed against the roller 24, which is a fluid dispersing roller. The roller 24 in the preferred embodiment is an idler roller and is rotated by the rotation of the fluid applicator roller 22 as that roller is rotated while it moves over a surface to which fluid is being applied. In the preferred embodiment, the fluid being applied is paint, but other fluids can be used without departing from the scope of the present invention.

The paint source 14 includes a container 30 having a lid 32 removably mounted thereon. A mounting frame 36 which includes an L-shaped bracket having a base 40 and a back 42 is releasably mounted on the lid 32 by clamps 46 which are connected to the base 40 by hinges 48 and which have depending lips 50 for clasping the lid 32.

The motor 18 is mounted on the frame back 42 and includes a cord 52 attaching that motor to a power source (not shown). A shaft 54 extends from the motor into a coupling 56 and extends through the bracket base and through the lid 32 into the interior of the container.

A fluid pump 58 is mounted on the container 30 and includes a hollow pump tube 60 which is mounted on the interior face of the lid to extend downwardly therefrom into the container, and a motor shaft, or an extension thereof, which extends axially through the pump tube. A pump screw 66, which can be in the shape of an Archimedes' screw, is mounted on the shaft for rotation therewith within the pump tube. Rotation of the screw drives liquid upwardly toward the lid.

The flexible hose 16 is fluidly coupled to the pump screw 66 and is mounted on the base 40 by a coupling 70. Paint, or other fluid, contained in the container 30 is thus moved into the hose 16 by the pump 58 as indicated by arrows 72 in FIG. 1.

The frame 12 includes a cylindrical handle 80 having external threads 82 on one end thereof for coupling the handle to an extension means, or the like. A coupling C can also be included in hose 16 for increasing the reach of that hose, as well as for clean-out purposes. The electric cord 20 is connected to an on/off switch 84 by which operation of the motor 18 is controlled. A side plug is electrically connected to the switch 84 so that a remote control means can be used to operate the switch 84 when suitable.

The handle is connected at the other end thereof to a roller carriage 90. The carriage includes a swivel connection 92 to which the handle is threadably attached and a J-shaped mounting rod 94 to which the swivel is pivotably attached. The mounting rod includes a long leg 96 and a short leg 98 connected to the long leg by a bight section 100. The swivel 92 includes a body 102 through which the rod long leg is received and a set screw 106 for firmly and immovably attaching the carriage to the handle via the swivel connection. The angle of the carriage with respect to the handle can thus be set using the set screw and the swivel connection.

Figure 2:
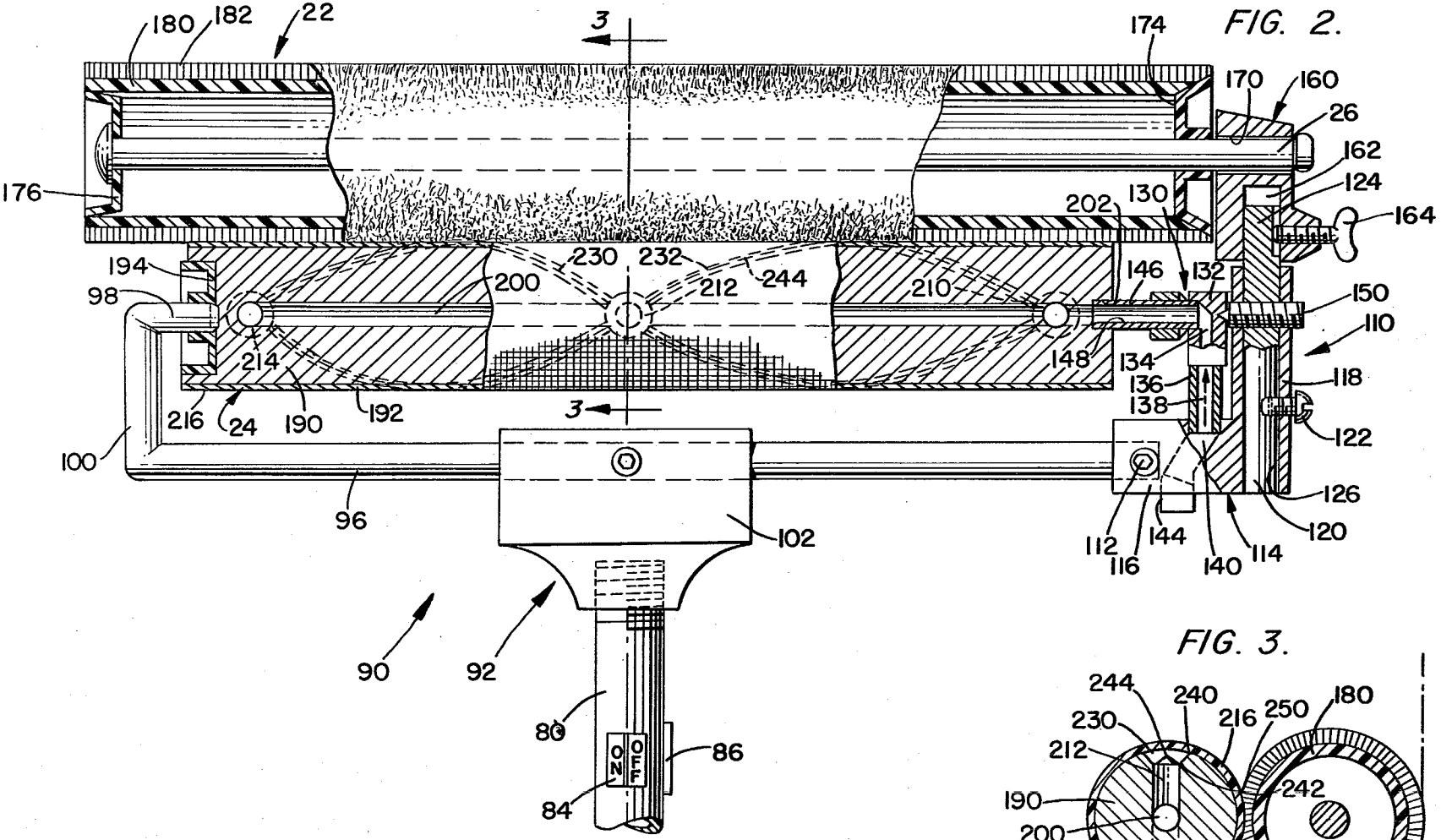
FIG. 2 is a plan view of the applicator shown in FIG. 1.

As best shown in FIG. 2, a coupling arm 110 is attached to the carriage long leg by a set screw 112. The coupling arm includes an L-shaped bracket 114 having a base 116 and a back 118 with the set screw being located in the base 116 and an adjustment shaft 120 mounted in the back 118 to be slidable therein longitudinally of the shaft. A shaft set screw 122 is used to fixably attach the adjustment shaft 120 to the bracket. The shaft includes a lug 124 on the top thereof and the position of the lug with respect to the coupling arm is set by moving the shaft longitudinally within the bore 126 defined in the back 118.

A coupling 130 is mounted on the coupling arm 110 and includes a body 132 having a fluid passage 134 defined therethrough. A coupling tube 136 is mounted at one end thereof on the base 116 and at the other end thereof to the body 132 and has a fluid passage 138 defined therethrough. A fluid passage 140 is defined through the base 116 and a fluid coupling tube 144 fluidly attaches the hose 16 to the base 116 and to the fluid passage 140 to be fluidly connected to the fluid passage 134 via passage 138. A coupling shaft 146 has a fluid passage 148 defined therethrough and is attached at one end thereof to the coupling 130 so that the passage 148 is in fluid communication with passage 138 to receive fluid therefrom. An adjustment and centering screw 150 further couples the coupling 130 to the coupling arm 110. The screw 150 maintains the coupling arm 130 in the desired orientation on the arm 110.

A head 160 has a bore 162 defined therein and is attached to the lug 124 by a wing nut 164 with the lug accommodated in the bore 162. The position of the head with respect to the coupling arm 110 is set and, using the wing nut 164, the head is attached to the shaft 120 via the lug.

The head has a further bore 170 defined therein which receives shaft 26 on which the paint applicator roller 22 is mounted. The paint applicator roller 22 is usual to the painting field and includes end caps 174 and 176 which are rotatably mounted on the shaft 26 so that the roller rotates during a paint application procedure, a base tube 180 and a paint applicator covering 182 mounted on that base tube. The position of the paint applicator roller with respect to the base 116 is set by adjusting the head 160 and/or the shaft 120.

The idler roller 24 is rotatably mounted at one end thereof to the carriage short leg 98 and at the other end thereof to the coupling shaft 146. The roller 24 includes a tubular body 190 around which a porous covering 192 is mounted and an end cap 194 attaching the body to the carriage short leg. A central fluid passage 200 extends longitudinally and axially through the roller body and is fluidly connected to the fluid passage 148 in the coupling shaft to be fluidly connected to the flexible hose 16 for fluid connection to the fluid source 14. A counterbore 202 is defined in the roller body for accommodating the coupling shaft 146.

Figure 3:
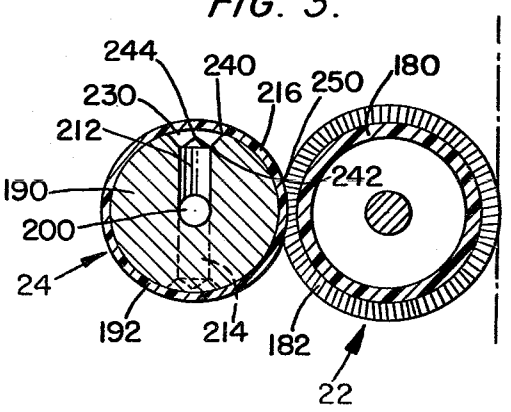
FIG. 3 is a view taken along line 3—3 of FIG. 2.

As shown in FIGS. 2 and 3, a plurality of fluid transfer passages 210, 212 and 214 are defined in the roller body to extend radially thereof and to have one end thereof fluidly connected to the fluid passage 200. The transfer passages extend from the fluid passage 200 to near outer surface 216 of the roller body 190.

A pair of helical fluid troughs 230 and 232 are defined in the roller body and are downwardly convergent in shape toward transfer passage outer end 242.

As best shown in FIG. 2, the fluid troughs intersect each other at central transfer passage 212 and each have the outer ends thereof fluidly coupled together via outer transfer passages 210 and 214. The fluid troughs receive fluid from all of the transfer passages as indicated by arrows AF in FIG. 1. As best shown in FIG. 3, the troughs are depthwise constricting, and thus have a width dimension which decreases from a maximum at or near the topmost section thereof to a minimum at the bottom of each channel. A maximum width location on trough 230 is indicated by reference indicator 240 in FIG. 3, and a minimum width location is indicated by indicator 242 in that figure. A ridge 244 is also included in both fluid troughs 230 and 232. The ridges extend from fluid source to fluid source and establish a capillary action in the fluid troughs to produce an even point distribution. In the preferred embodiment, the maximum height of the ridges is not more than one-third of the depth of the trough as measured between locations 240 and 242.

Fluid from the source 14 is transferred to the surface of the idler roller and passes through the porous covering 192 to be evenly applied to the covering 182 of the roller 22 for application to a suitable surface as best indicated by arrows AP in FIG. 1. Because of the helical shape of the fluid troughs, efficient transfer of fluid from the source to the roller 22 is effected. Contact between the rollers 22 and 24 is best shown in FIG. 3 at contact point 250, and the pressure exerted at this contact point is adjusted by moving the roller 22 relative to the roller 24 using the adjustment arm 110 as above described. This pressure is adjusted to insure a smooth, even application of fluid to the roller 22.

Fluid flow is adjusted by operating the on/off switch 84 to pump fluid into the hose 16, or to shut down such fluid movement. For example, the switch can be operated to pump fluid during the forward stroke of the unit 10, that is, a stroke moving the unit upward in FIG. 2, and to stop fluid flow during a rearward stroke. Other combinations can be used and still not depart from the scope of the present invention.

Actuation of the switch activates the motor 18 which causes rotation of the screw 66 to force fluid from the container into the hose 16. The fluid moves from the hose into the fluid passage 138 via fluid passages 140 and 144, and then into fluid passage 200 via fluid passage 148. The fluid flows into the helical troughs via the transfer passages and then through the porous covering on the roller 22 to be evenly applied to the covering 182 of the roller 22. Once on the roller covering 182, that fluid is evenly applied to a suitable surface.

As this invention may be embodied in several forms without departing from the spirit or essential characteristics thereof, the present embodiment is, therefor, illustrative and not restrictive, since the scope of the invention is defined by the appended claims rather than by the description preceding them and all changes that fall within the metes and bounds of the claims or that form their functional as well as conjointly cooperative equivalents are, therefore, intended to be embraced by those claims.

We claim:

1. A fluid applicator for applying fluid, such as paint or the like, to a surface, comprising:

a source of fluid;

a pump fluidly connected to said source of fluid;

a frame having a fluid passage therein fluidly connected to said pump;

a fluid applicator roller rotatably mounted on said frame;

a fluid dispersing roller rotatably mounted on said frame to contact said fluid applicator roller, said fluid dispersing roller including a central fluid passage defined to extend axially of said fluid dispersing roller and to be in fluid communication with said frame fluid passage to receive fluid therefrom, a plurality of fluid transfer passages extending radially of said fluid dispersing roller and being in fluid communication with said central fluid passage, and a pair of helical fluid troughs defined in the outer surface of said fluid dispersing roller to be in fluid communication with said transfer passages to receive fluid therefrom, said helical troughs each intersecting each fluid transfer passage and each having a width dimension which decreases to a minimum adjacent a transfer passage, each of said helical fluid troughs including a ridge within each trough to establish capilliary action, said pump pressurizing fluid in said helical ridged troughs; and control means on said frame for controlling said pump.

2. The fluid applicator defined in claim 1 further including a porous cover surrounding said fluid dispersing roller.

3. The fluid applicator defined in claim 1 wherein said frame includes a handle and a carriage movably connected to said handle, said carriage including a support rod attached to said fluid dispersing roller, an adjustment arm connected to said support rod and a head movably connected to said adjustment arm supporting said fluid applicator roller.

4. The fluid applicator defined in claim 3 further including a fluid passage defined in said adjustment arm, said arm fluid passage being in fluid communication with said pump, and a coupling mounted on said arm and connected to said dispersing roller, said coupling having a fluid passage defined therein, said coupling fluid passage being in fluid communication with said arm fluid passage and said dispersing roller central fluid passage to transfer fluid to said central fluid passage.

5. The fluid applicator defined in claim 4 further including attaching means on said handle for attaching extension means to said handle.

6. The fluid applicator defined in claim 5 wherein said pump includes a mounting frame releasably attached to a container of fluid, a motor mounted on said mounting frame and having a drive shaft extending into the container, a pump tube inside the container of fluid, a screw means inside the container and attached to the motor drive shaft, and a fluid hose fluidly connecting said screw means and said pump tube to said adjustment arm fluid passage.

7. The fluid applicator defined in claim 6 further including a centering means on said adjustment arm contacting said coupling.

8. The fluid applicator defined in claim 1 wherein said pump includes a helical screw fluid conveyor which is fully immersed in a source of fluid.

9. The fluid applicator defined in claim 1 wherein said fluid dispersing roller has only three fluid dispersal transfer passages.

10. The fluid applicator defined in claim 1 further including adjustment means on said frame for moving said fluid applicator and dispersing rollers with respect to each other.

11. A fluid applicator for applying paint to a surface comprising: a source of paint; a pump fluidly connected to said source of paint; a frame having a fluid passage therein fluidly connected to said pump; a fluid applicator roller rotatably mounted on said frame; a fluid dispersing roller rotatably mounted on said frame to contact said fluid applicator roller, said fluid dispersing roller having an axially extending central fluid passage therein for fluid communication with said frame fluid passage to receive fluid therefrom, a plurality of radial fluid transfer passages in said fluid dispersing roller in fluid communication with said central fluid passage, a pair of helical fluid troughs defined in the outer surface of said fluid dispersing roller to be in fluid communication with said radial transfer passages to receive fluid therefrom, said helical troughs each intersecting each fluid transfer passage and each having a width dimension which decreases to a minimum adjacent a transfer passage, each of said helical fluid troughs including a ridge within said trough to establish capilliary action, said pump pressurizing fluid in said helical ridged troughs; said pump including a helical screw fluid conveyor which is fully immersed in the source of paint; said frame including a handle, control means on said handle for controlling said pump, an adjustment arm connected to a support rod for said fluid dispersing roller, and a head movably connected to said adjustment arm supporting said fluid applicator roller.

12. The fluid applicator defined in claim 1, including a fluid passage defined in said adjustment arm, said arm fluid passage being in fluid communication with said pump, and a coupling mounted on said arm and connected to said dispersing roller, said coupling having a fluid passage defined therein, said coupling fluid passage being in fluid communication with said arm fluid passage and said dispersing roller central fluid passage to transfer fluid to said central fluid passage, said pump including a mounting frame releasably attached to a container of fluid, a motor mounted on said mounting frame and having a drive shaft extending into the container, a pump tube inside the container of fluid with said helical screw inside the container and attached to the motor drive shaft, and a fluid hose fluidly connecting an output of said pump tube to said adjustment arm fluid passage, and a centering means on said adjustment arm contacting said coupling.

* * * * *